United States Patent [19]

White et al.

[11] Patent Number: 4,806,826

[45] Date of Patent: Feb. 21, 1989

[54] HIGH PRESSURE SODIUM VAPOR DISCHARGE DEVICE

[75] Inventors: Philip J. White, Georgetown; David A. Goodman, Salem, both of Mass.

[73] Assignee: GTE Products Corporation, Danvers, Mass.

[21] Appl. No.: 942,331

[22] Filed: Dec. 16, 1986

[51] Int. Cl.[4] ..... H01J 17/04; H01J 17/24

[52] U.S. Cl. ..... 313/631; 313/633; 313/558

[58] Field of Search ..... 313/623, 631, 633, 558, 313/559, 355, 346 R, 549, 561, 630; 252/181.3, 181.6

[56] References Cited

U.S. PATENT DOCUMENTS

| | | | |
|---|---|---|---|
| 2,304,412 | 12/1942 | Kern et al. | 313/558 |
| 2,731,581 | 1/1956 | Krefft | 313/631 X |
| 3,700,951 | 10/1972 | Clarke et al. | 313/346 R |
| 4,303,846 | 12/1981 | Kimura et al. | 313/558 |
| 4,366,410 | 12/1982 | Buhrer | 313/625 X |
| 4,574,219 | 3/1986 | Davenport et al. | 313/355 X |
| 4,620,129 | 10/1986 | Luthra | 313/630 |

*Primary Examiner*—David K. Moore
*Assistant Examiner*—Michael Horabik
*Attorney, Agent, or Firm*—Martha Ann Finnegan

[57] ABSTRACT

A high pressure sodium vapor discharge device including a polycrystalline alumina arc tube which contains a fill including sodium and mercury is disclosed. An electrode is disposed at each end of the arc tube, and an emissive material including an oxygen getter, such as, zirconium and/or niobium, and thorium dioxide is coated on at least one of the electrodes. The improved emissive material coating reduces the rate of sodium loss from the arc tube and inhibits loss of luminosity due to discoloration of the arc tube.

20 Claims, 3 Drawing Sheets

HIGH PRESSURE SODIUM VAPOR DISCHARGE DEVICE

TECHNICAL FIELD OF THE INVENTION

The present invention relates to high pressure sodium vapor discharge devices, and more particularly to high pressure sodium vapor discharge devices including electrodes having coatings thereon.

BACKGROUND OF THE INVENTION

High pressure sodium lamps containing unsaturated fills of sodium and mercury are known to the art, as are lamps which use electrodes that include thorium oxide as an emissive material. Such lamps have frequently suffered from a loss of sodium as a constituent of the arc stream which is confined within the arc tube during operation of the lamp. The loss of this sodium reduces the luminosity of the lamp.

Sodium loss can be attributed to several factors. For example, arc tubes that are used for this type of lamp are commonly formed of polycrystalline alumina which can be shaped in a tube-like configuration and sealed at the ends with caps, also formed of alumina. The caps are fused to the envelope with a glass-ceramic frit. These lamps operate at temperatures such that the sodium of the fill can strip oxygen from the enclosed gaseous atmosphere, the alumina of the envelope, the emissive cathode coating, and also from the frits that are used to form the seals. A sodium oxide reaction product is formed by the stripping. This sodium oxide compound will deposit on the arc tube wall in layer-like configuration and will reduce the transmission of light through the envelope. Also, the stripping of the oxygen from the alumina produces a greying discoloration on the inside of the arc tube. This discoloration also reduces the luminosity of the lamp. Thus, it is desirable to remove as much of the oxygen from the arc tube, so as to eliminate these problems.

As generally practiced, before a lamp is fabricated, as much of the oxygen as possible is removed from the unassembled parts, usually by firing them in a hydrogen atmosphere or under vacuum. It has also been conventional to compensate for the sodium which will be lost during operation of the lamp due to the reaction with the oxygen. This approach requires the lamp maker to "saturate" the arc tube with a significant excess of sodium, such lamps having quantities of sodium and mercury sufficient to allow a pool of these metals to remain in the arc tube, even when the lamp is operating.

One known attempt to reduce the sodium loss problem is an effort to reduce the level of oxygen impurity of the lamp which, in turn, reduces the sodium loss since there is a shortage of oxygen for combination with the sodium. Such an effort is set forth in U.S. Pat. No. 4,075,530 by Furukubo et al. wherein a decomposable material, $NaN_3$, is located in an adjacent exhaust tube, heated to decompose the $NaN_3$ and cooled to condense to a resultant material while the undesired nitrogen gas is withdrawn. Obviously, such a process is relatively cumbersome of apparatus and expensive of labor and materials.

Other attempts to remove oxygen have included the disposition of a getter within the arc tube of the lamp, such as disclosed in the co-pending U.S. Application, Ser. No. 473,895 filed Mar. 10, 1983 and assigned to the same assignee as the present application. Another approach has been to use electrodes including thereon an emissive material having a free energy of formation per mole of oxygen more negative than the free energy of formation of barium oxide, such as described in the co-pending application, Ser. No. 858,552, filed Apr. 23, 1986, which is a continuation application of Serial No. 539,605, filed Oct. 6, 1983, now abandoned, and assigned to the same assignee as the present invention.

Other approaches for removing the deleterious oxygen have included coating a getter material on a substrate and disposing a disc of the coated substrate on the shank of the electrode, such as disclosed in the co-pending application, Ser. No. 473,897 filed Mar. 10, 1983, and assigned to the same assignee as the present invention.

Japanese Kokai Patent No. SHO 57(1982)-9044 of Mitsubishi Denki K.K., based on application No. 515-83057 of June 19, 1980, discloses the preparation of an electrode for a discharge lamp formed from thoriated tungsten containing thorium dioxide as an electron emitting material.

In the European patent application to General Electric, No. 0,193,714 of Jan. 17, 1986, the use of an emissive coating of calcium, barium, tungsten oxide having a specific composition defined in terms of the triaxial plot of FIG. 3 thereof with zirconium, hafnium and yttrium metal included as a getter is disclosed.

SUMMARY OF THE INVENTION

In accordance with the present invention there is provided a high pressure sodium vapor discharge device comprising an arc tube having a fill including sodium and mercury; and a pair of electrodes sealed through opposite ends of the arc tube; and means to connect current to each of the electrodes; and an emissive material comprising an oxygen getter and thorium dioxide coated on at least one of the electrodes.

For a better understanding of the present invention, together with other and further objects, advantages and capabilities thereof, reference is made to the following disclosure and appended claims in connection with the above-described drawings.

BEST MODE FOR CARRYING OUT THE INVENTION

Figure 1:
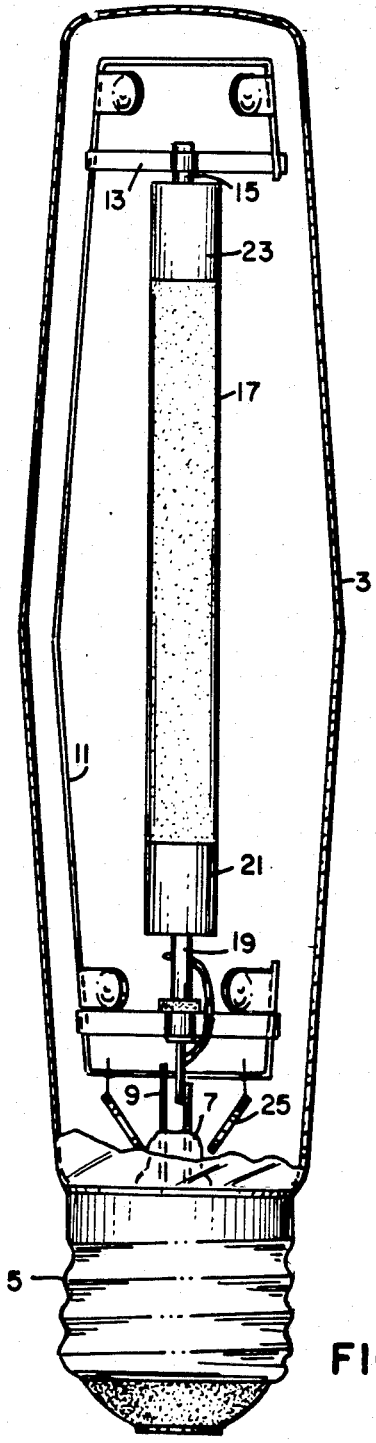
FIG. 1 is an elevational perspective view of a high pressure sodium lamp of the present invention.

Referring to the drawings, FIG. 1 illustrates a sodium vapor discharge device of the invention. Herein, a glass envelope 3 is formed for insertion in a normal screw type metal base 5. A glass stem portion 7 is hermetically sealed to the glass envelope 3 and extends inwardly therein. The stem portion 7 has a plurality of electrical conductors 9 sealed therein and extending therethrough. An electrically conductive support member 11 is affixed to one of the electrical conductors 9 and to a metal cross-member 13 which is attached to an electrode 15 at one end of an elongated polycrystalline alumina arc tube 17. Another electrode 19 is located at the opposite end of the arc tube 17 and attached to one of the electrical conductors 9 passing through the stem portion 7. Preferably, heat insulating sleeves 21 and 23 are slipped over the opposite ends of the arc tube 17 in the vicinity of the electrodes 19 and 15, respectively. Preferably, the envelope 3 is evacuated and at least one getter device 25, preferably barium, is positioned adjacent the stem portion 7.

Further, a fill including sodium and mercury is disposed within the arc tube 17. The fill of mercury and sodium may be of an amount sufficient to "saturate" or provide an excess amount of sodium therein, but preferably only sufficient sodium and mercury is added to provide an unsaturated vapor type lamp. A "saturated" lamp is one in which a gas phase is saturated with mercury and sodium and a pool of excess sodium and mercury can remain in the arc tube when the lamp is operating. Lamps of the "unsaturated" type do not have a pool of excess sodium and mercury during operation. The appropriate amounts of sodium and mercury to obtain an unsaturated condition are well known to the art.

Figure 2:
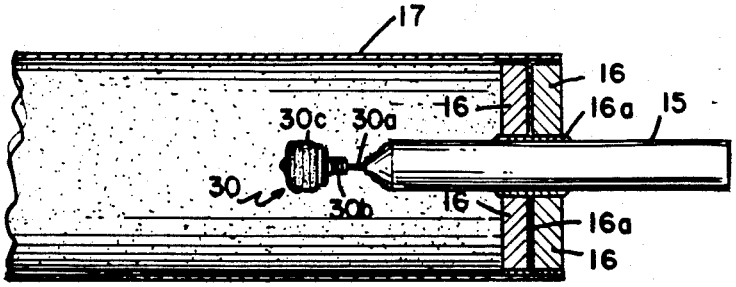
FIG. 2 is a side elevational view, partially in cross-section, of an arc tube and electrode configuration suitable for use in the present invention.

Referring to FIG. 2, the arc tube includes a conventional polycrystalline alumina tube 17 which is transparent to light that is emitted by an arc formed within the arc tube. A pair of alumina buttons 16 are attached to the arc tube 17 by a conventional frit 16*a*. Another pair, not shown, is attached to the other end, also not shown. In a preferred embodiment, two alumina buttons 16 are disposed in the arc tube in a back-to-back relationship and joined together with a frit 16*a*. A niobium rod or tube 15 is axially disposed in the alumina buttons 16 and is secured to the alumina buttons 16 by the frit 16*a*. An end of electrode 30 is disposed within the center of the niobium tube 15 on a stem 30*a*. The stem 30*a* supports the electrode upon which an arc that will be formed in the tube when the lamp is operated. Preferably, the electrode is formed of a screw-wrapped base section of tungsten wire with an over-screw section 30*b* which can be wound over the base section. The stem 30*a* is disposed on the axis of the windings. An emissive material coating 30*c* in accordance with the present invention, comprising thorium dioxide and an oxygen getter (the composition of which will be more particularly described hereinafter) is disposed on the electrode.

To prepare the coated electrodes, the emissive material including thorium dioxide and an oxygen getter, such as, niobium and/or zirconium, is admixed and slurried in water, methanol or another suitable volatile carrier. Each of the solid constituents has a particle size less than about 5 microns. Above 5 microns, the particles cannot adequately seat themselves in the coils of the electrodes. The amount of oxygen getter in the emissive coating material is from about 1 to about 95 weight percent; and preferably from about five to about fifty weight percent. Most preferably the amount of oxygen getter in the emissive coating is from about five to fifteen weight percent (5.–15. Wt. %). The balance of the emissive material is thorium dioxide. Below about 1. Wt. %, there is insufficient gettering and above 95. Wt. %, there is insufficient thorium dioxide to form the arc in the tube.

Following the preparation of the slurry, the electrodes are then vacuum impregnated with the emission mix and dried. Then the coated electrodes are subjected to a high temperature vacuum sintering at temperatures between about 1400° C. and 1800° C. A coated electrode is formed. In the finished structure, the thorium dioxide acts as the emissive material and the niobium and/or zirconium acts as the getter, when the metal is in the ranges of particle sizes defined herein and when the ratio of emissive material to getter metal is in the stated proportions.

Quite suprisingly, it has been found that in the present invention that although oxygen getters such as zirconium and/or niobium getters can have an undesirable side effect of greying the arc tube, this effect occurs when the metal is disposed near the seal buttons 16. Of course, the greying reduces the light output of the lamp, and as such, is quite undesirable. Such greying is not observed, however, when a mixture of thorium dioxide and oxygen getter metal is disposed in a coating upon the electrode itself. In accordance with the present invention the temperature at the end of the arc tube 17, near the button 16, is almost 500° K. lower than the temperature at the electrode 30 during lamp operation. When a zirconium getter is disposed near the button 16, where the temperature is only about 1100° K., it will strip oxygen from the polycrystalline alumina that forms the arc tube wall. This stripping of the oxygen from the arc tube is because the free energy of formation of zirconium dioxide at 1100° K. is lower than the free energy of formation of aluminum oxide at the wall temperature of 1500° K. When niobium metal is used as a getter, again situated near the button 16, its gettering properties are insufficient because the reaction of oxygen with niobium to form niobium oxide occurs at a temperature of approximately 1000° K.

When either of the metals, niobium or zirconium, is mixed with thorium dioxide and coated upon the electrode coil, the gettering situation is reversed because of the higher temperature of the electrode, generally about 1500° K. When zirconium is the getter, the free energy of formation of zirconium dioxide at the electrode temperature is greater than the free energy of formation of aluminum oxide at the wall temperature of 1500° K. Thus, there is no tendency for the getter to scavenge oxygen from the wall and cause greying of the arc tube. At the operating temperature of the electrode, niobium metal has also been found to act as a getter because of its use in powdered form, which increases its surface area and also because at this temperature, the reaction rate for niobium combining with oxygen to form niobium oxide is acceptable. Lamps made with a thorium dioxide-niobium electrode coating mixture exhibit a sodium loss rate which is five times slower than lamps made with electrodes coated with thorium dioxide alone.

Figure 3:
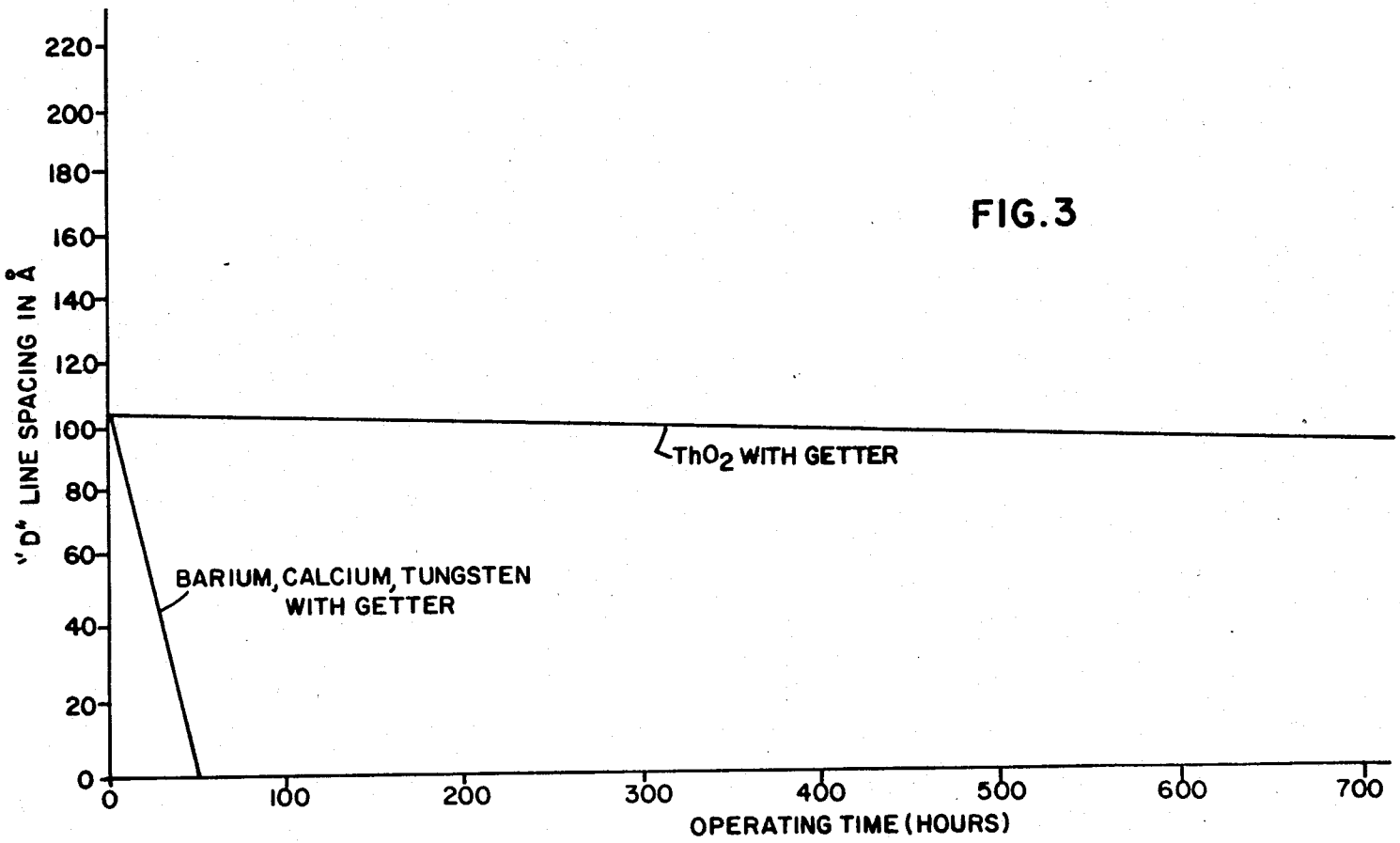
FIG. 3 are curves comparing the spacing in the "D"-line between an unsaturated sodium lamp using conventional barium, calcium, tungstate emissive material and an unsaturated sodium lamp using an emissive material in accordance with the present invention.

As shown in FIG. 3, it can be seen that unsaturated vapor type high pressure sodium lamps using dibarium calcium tungstate emissive coating containing powdered zirconium as a getter show substantially no "D" line spacing within about 40 hours of testing, whereas with an emissive coating material of the present invention containing about 10 weight percent finely divided zirconium powder and about 90 weight percent finely divided thorium dioxide, the "D" line spacing is fairly constant over the entire life cycle testing. "D" line spacing is a measure of the quantity of sodium present in the arc stream, and as the quantity of sodium decreases, the space between the two principal emission lines of the sodium, the "D" line spacing, will decrease.

While there has been shown and described what are considered preferred embodiments of the present invention, it will be obvious to those skilled in the art that various changes and modifications may be made therein without departing from the invention as defined by the appended claims.

What is claimed is:

1. A high intensity sodium vapor discharge device comprising:

an arc tube having a fill including sodium and mercury;

a pair of electrodes sealed through opposite ends of said arc tube;

means to connect current to each of said electrode; and an emissive material comprising an admixture of an oxygen getter and thorium dioxide coated on at least one of said electrodes.

2. The high intensity sodium vapor discharge device according to claim 1 wherein the arc tube is formed of polycrystalline alumina.

3. The high intensity sodium vapor discharge device according to claim 2 wherein the polycrystalline alumina tube is sealed at each end with at least one section of substantially flat polycrystalline alumina having a hole formed in said section, said section being sealed to said tube with a glass frit and said electrodes being disposed in said holes and sealed thereto, whereby an envelope is formed.

4. The high intensity sodium vapor discharge device according to claim 1 wherein the oxygen getter is finely divided and is selected from the group consisting of niobium, zirconium, and mixtures thereof.

5. The high intensity sodium vapor discharge device according to claim 4 wherein there is from about 1 to about 95 weight percent oxygen getter in the admixture.

6. The high intensity sodium vapor discharge device according to claim 1 wherein there is from about 5 to about 50 weight percent oxygen getter in the admixture.

7. The high intensity sodium vapor discharge device according to claim 6 wherein there is from about 5 to about 15 weight percent oxygen getter in the admixture.

8. The high intensity sodium vapor discharge device according to claim 1 wherein the electrode is a coil of tungsten wire disposed upon a niobium stem.

9. The high intensity sodium vapor discharge device according to claim 1 wherein the emissive material is disposed at a location on said electrode wherein the temperature is near the maximum operating temperature of the lamp.

10. A high pressure sodium vapor discharge device comprising:

an arc tube having an unsaturated fill including sodium and mercury;

a pair of electrodes sealed through opposite ends of said arc tube;

means to connect current to each of said electrodes; and a mixture of powdered oxygen getter and thorium dioxide coated on at least one of said electrodes, said oxygen getter being selected from the group consisting of zirconium, niobium, and mixtures thereof.

11. The high pressure sodium vapor discharge device according to claim 10 wherein the oxygen getter has a particle size less than about 5 microns.

12. The high pressure sodium vapor discharge device according to claim 10 wherein the arc tube is formed of polycrystalline alumina.

13. The high pressure sodium vapor discharge device according to claim 12 wherein the polycrystalline alumina tube is sealed at each end with at least one section of substantially flat polycrystalline alumina having a hole formed in said section, said section being sealed to said tube with a glass frit and said electrodes being disposed in said holes and sealed thereto, whereby an envelope is formed.

14. The high pressure sodium vapor discharge device according to claim 13 wherein the particles of the oxygen getter and the thorium dioxide have a size less than about 5 microns.

15. The high pressure sodium vapor discharge device according to claim 10 wherein there is from about 1 to about 95 weight percent oxygen getter in the mixture.

16. The high pressure sodium vapor discharge device according to claim 10 wherein there is from about 1 to about 5 to about 50 weight percent oxygen getter in the mixture.

17. The high pressure sodium vapor discharge device according to claim 15 wherein the weight percent is from about 5 to about 15.

18. The high pressure sodium vapor discharge device according to claim 11 wherein the electrode is a coil of tungsten wire disposed upon a niobium stem.

19. The high pressure sodium vapor discharge device according to claim 11 wherein the mixture of powdered oxygen getter plus thorium dioxide is disposed at a location on said electrode wherein the temperature is near the maximum operating temperature of the lamp.

20. The high pressure sodium vapor discharge device according to claim 18 wherein the electrode temperature is about 1500° K.

* * * * *